US008162454B2

(12) United States Patent
Fukazawa

(10) Patent No.: US 8,162,454 B2
(45) Date of Patent: Apr. 24, 2012

(54) INK JET RECORDING APPARATUS AND LIQUID SUPPLY APPARATUS

(75) Inventor: Hideo Fukazawa, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 644 days.

(21) Appl. No.: 12/269,882

(22) Filed: Nov. 12, 2008

(65) Prior Publication Data

US 2009/0102898 A1 Apr. 23, 2009

Related U.S. Application Data

(63) Continuation of application No. 11/338,076, filed on Jan. 24, 2006, now Pat. No. 7,465,044.

(30) Foreign Application Priority Data

Jan. 27, 2005 (JP) ..... 2005-020312

(51) Int. Cl.
*B41J 2/175* (2006.01)

(52) U.S. Cl. ..... 347/85

(58) Field of Classification Search ..... 347/84–87, 347/40, 42, 43, 49, 50, 13, 18
See application file for complete search history.

(56) References Cited

U.S. PATENT DOCUMENTS

| | | | | |
|---|---|---|---|---|
| 6,520,630 | B1 * | 2/2003 | Oda et al. | 347/85 |
| 6,702,427 | B2 * | 3/2004 | Shimizu et al. | 347/50 |
| 6,702,433 | B2 * | 3/2004 | Kono | 347/85 |
| 6,742,872 | B2 * | 6/2004 | Fukazawa et al. | 347/50 |
| 6,969,161 | B2 * | 11/2005 | Kuwabara et al. | 347/85 |
| 7,004,574 | B2 * | 2/2006 | Neese et al. | 347/85 |
| 7,118,204 | B2 * | 10/2006 | Hatasa et al. | 347/86 |

FOREIGN PATENT DOCUMENTS

| | | |
|---|---|---|
| JP | 2001-001540 | 1/2001 |
| JP | 2001-187459 | 7/2001 |

* cited by examiner

*Primary Examiner* — Kristal Feggins
(74) *Attorney, Agent, or Firm* — Canon USA Inc IP Division

(57) ABSTRACT

An ink jet recording apparatus supplying ink from a main tank to a head via a sub tank. The sub tank has two flow paths communicating with the main tank, an atmosphere communicating part, and a liquid exit part to the head. The liquid in the sub tank is maintained at a constant liquid level position by selecting, between the two flow paths, the flow path having a lower flow path resistance. Thus, the ink jet recording apparatus can store a predetermined amount of liquid stably in the sub tank. The ink jet recording apparatus and the liquid supply apparatus are capable, even when the main tank is detached or the ink therein is exhausted, of continuing the recording for a predetermined time or number of sheets, utilizing the ink in the sub tank.

5 Claims, 7 Drawing Sheets

700

INK JET RECORDING APPARATUS AND LIQUID SUPPLY APPARATUS

CROSS-REFERENCE TO RELATED APPLICATIONS

This application is a continuation of U.S. patent application Ser. No. 11/338,076 filed Jan. 24, 2006, which claims the benefit of Japanese Patent Application No. 2005-020312 filed Jan. 27, 2005, all of which are hereby incorporated by reference herein in their entirety.

BACKGROUND OF THE INVENTION

1. Field of the Invention

The present invention relates to a liquid supply apparatus for supplying a liquid to a discharge head for discharging a liquid such as ink. The present invention particularly relates to a liquid supply apparatus and an ink jet recording apparatus in which a liquid, supplied from a main tank containing the liquid, is stored in a sub tank, from which the liquid is supplied to a discharge head.

2. Related Background Art

In a known ink jet recording apparatus, an interior of a nozzle, having a discharge port for discharging ink in a recording head, is maintained at a negative pressure. This is for forming a meniscus of the ink within the nozzle, in order to avoid ink leakage from the nozzle and air intrusion from the exterior into the nozzle.

In such known ink jet recording apparatus, the following component is known for generating a meniscus in the discharge port of the recording head. This component includes a main tank for containing ink and a sub tank for storing the ink supplied from the main tank and for supplying a recording head with the ink, in which the sub tank is positioned lower than the recording head in the vertical direction.

In such system, an ink supply from the sub tank to the recording head is executed utilizing a water head difference between the sub tank and the recording head. In the known ink supply apparatus, a chicken feed method is known as a simple structure for executing the ink supply from the main tank to the sub tank. A chicken feed configuration involves a container having an opening which is opened upon liquid being filled to the top of the container. The ink supply structure by the chicken feed is disclosed in FIG. 3 of U.S. Pat. No. 6,024,442 and FIG. 3 of U.S. Pat. No. 6,338,552. A prior ink supply apparatus of the chicken feed method, disclosed in Japanese Patent Application Laid-open No. H03-247460, is shown in FIG. 1. An ink-containing air-tight replaceable main tank is mounted on a tank mounting portion in the recording apparatus, whereby the ink is supplied from the main tank to the sub tank through an ink supply tube. However, in the ink supply apparatus of such structure, the main tank is provided, at an ink supply aperture thereof, with a spring-biased valve which is to be opened upon mounting in the recording apparatus. Such valve may be opened, for example, by an impact when the main tank is dropped, thereby causing ink leakage.

For preventing such ink leakage, the following structure is already known. As shown in FIG. 7, an ink supply apparatus 700 is equipped with an ink supply needle 703 and an air introducing needle 704. The ink supply needle 703 is provided for ink supply from an ink-containing air-tight replaceable main tank 701 to a sub tank 702, and the air introducing needle 704 is provided for introducing air into the main tank 701, when the liquid is replaced by air. The ink supply apparatus is equipped with a supply base 705, having these hollow needles. In the main tank 701, an aperture of a connecting part to be connected to the supply base 705 is closed by a rubber stopper 706. At the connection with the supply base 705, the ink supply needle 703 and the air introducing needle 704 pierce the rubber stopper 706, thereby communicating with the interior of the main tank 701. Thus an ink supply from the main tank 701 is executed through these two needles to the supply base 705, from which the ink is supplied to the sub tank 702 through the ink supply tube 707.

The main tank 701 is provided, at the connecting part thereof, with the elastic rubber stopper 706. When the main tank 701 is extracted from the ink supply needle 703 and the air introducing needle 704 of the supply base 705, the piercing holes are closed air-tight by the elasticity of the rubber stopper 706. It is thus possible to satisfactorily secure the air-tightness in the connecting part of the main tank 701, thereby sufficiently preventing ink scattering from the connecting part in case the main tank 701 is dropped.

It is necessary to prevent the rubber stopper 706 to be pierced by the ink supply needle 703 and the air introducing needle 704 from breaking by cracking at the piercing. To avoid breakage, these two hollow needles are restricted at where the internal diameter increases. The internal diameter of the ink supply needle 703 and the air introducing needle 704 is usually selected at about 1.6 mm.

Also Japanese Patent Application Laid-open No. 2002-234180 discloses a constitution of chicken feed of connecting an air-tight replaceable main tank by a hollow tube at a connecting part, thereby securing a water head difference with the recording head. Also, Japanese Patent Application Laid-open No. 2004-142442 discloses a chicken feed structure utilizing plural communicating tubes in the ink supply between a first ink tank and a closed second ink tank.

Such known chicken feed apparatuses utilizing a hollow air introducing needle, in case of employing a narrow air introducing needle with an internal diameter of about 1.6 mm, results in the following drawback. An ink meniscus is often formed in the interior or the air introducing needle which communicates to the external air or at a lower end portion of such air introducing needle, and such meniscus is in an uncertain state. In such prior liquid supply apparatus, a negative pressure generated by the water head difference in the closed main tank may become smaller than a meniscus force, thereby inhibiting the ink supply from the main tank to the sub tank and deteriorating the recording state by the recording head.

The ink supply structure by the chicken feed system disclosed in Japanese Patent Application Laid-open No. 2002-234180 does not show a specific constitution for maintaining a stable water head. Japanese Patent Application Laid-open No. 2004-142442 discloses a constitution of providing, for ink supply between a first ink tank and a closed second ink tank, plural communicating tubes in which the communicating paths have different internal diameters. In such constitution, however, the first tank is opened to the air, while the second ink tank is made air-tight. Therefore, what flows in the communicating tube varies depending on the condition of ink supply, so that each of the plural communicating tubes becomes an air flow path or a liquid flow path. Also, the second ink tank is provide therein with a spring member for generating a negative pressure. It is not so constructed to maintain a stable liquid level therein at a constant position, and the ink level therein is variable.

As described above, the known ink supply apparatus has the drawback in that the negative pressure fluctuates depending on an ink amount remaining in the main tank, whereby an ink liquid level in the sub tank tends to unstably fluctuate.

Also, in the known ink supply apparatus, the ink amount remaining in the sub tank fluctuates when the ink in the main tank is exhausted or when the main tank is detached. It is therefore difficult, when the ink in the main tank is no longer available, to ensure a recording time or a number of recording sheets for continuous recording with the ink remaining in the sub tank.

SUMMARY OF THE INVENTION

The present invention is directed to an ink jet recording apparatus and a liquid supply apparatus capable of stabilizing a liquid level of a liquid supplied from a main tank and stored in a sub tank, thereby storing the liquid of a required constant amount in the sub tank.

In one aspect of the present invention, an ink jet recording apparatus includes: a recording part configured to record and including a discharge head; a mounting part capable of mounting a main tank; and a sub tank adapted to store the liquid supplied from the main tank for supply to the discharge head. The sub tank includes: two flow paths communicating with the main tank; an atmosphere communication port; and a liquid exit part communicating with the discharge head, wherein one of the two flow paths has a flow path resistance lower than that of the other flow path.

The recording apparatus of the present invention is also characterized in that, among the flow paths provided in the sub tank, the flow path having the lower flow path resistance includes an air introducing path for introducing air into the main tank, and the other flow path includes a liquid supply path for supplying the liquid from the main tank to the sub tank.

The recording apparatus of the present invention is further characterized in that the air introducing path, provided in the sub tank, has a cross-sectional area, in a direction perpendicular to the air flow direction, larger than a cross-sectional area of the liquid supply path in a direction perpendicular to the liquid flow direction. In the recording apparatus of the present invention, the cross-sectional area of the air introducing path may vary along the air flowing direction.

Also, in the recording apparatus of the present invention, the air introducing path provided in the sub tank may have a length in the air flow direction shorter than a length of the liquid supply path in the liquid flow direction. Also, in the ink jet recording apparatus of the present invention, each of the two flow paths provided in the sub tank may be formed by connecting two flow path members.

Also in the ink jet recording apparatus of the present invention, the air introducing path provided in the sub tank may be positioned closer, than the ink supply path, to the liquid exit part to the discharge head.

The ink jet recording apparatus of the present invention is also characterized in that a bottom face of the sub tank has an inclined face becoming deeper toward the liquid exit part to the discharge head, and that the liquid exit part is formed in a proximity of a deepest part within the sub tank. The recording apparatus of the present invention is further characterized in that, within the air introducing path provided in the sub tank, a flow path portion having an enlarged cross-sectional area in a direction perpendicular to the air introducing direction is sized so as to inhibit a meniscus formation by the liquid. In addition to such constitution, the present invention is characterized in that a water head difference (H) in the vertical direction in the flow path portion of the enlarged cross-sectional area, a meniscus force (M) by the cross-sectional area in a flow path portion of a smaller cross-sectional area, and a flow path resistance (R) of the air introducing path and the ink supply path in the entire portion thereof having a smaller cross-sectional area satisfy a following relationship: $H>M+R$.

The present invention is further characterized in that a lower end position of the air introducing path provided in the sub tank defines a predetermined liquid level position and that a liquid amount secured in the sub tank by the liquid level position is a predetermined amount of the liquid capable of continuing a recording.

The predetermined amount of the liquid capable of continuing a recording means an amount capable of continuing the recording for a predetermined time. Also the predetermined amount of the liquid capable of continuing a recording may also be an amount capable of continuing the recording for a predetermined number of recording sheets.

According to another aspect of the present invention, a liquid supply apparatus includes a sub tank adapted to store a liquid supplied from a main tank for supply to a discharge head, in which the sub tank includes plural flow paths capable of communicating with the main tank upon mounting thereof, an atmosphere communication port, and a liquid exit part to the discharge head; wherein, among the plural flow paths, at least a flow path has a cross-sectional area enlarged in a direction perpendicular to the flow direction thereby having a lower flow path resistance than in other flow paths.

As explained above, the present invention allows for maintaining the liquid, supplied from the main tank and stored in the sub tank, at a constant liquid level and thereby stably storing the liquid of a constant amount in the sub tank. Thus, there can be provided an ink jet recording apparatus and a liquid supply apparatus, capable, even when the main tank is detached for any reason or the ink therein is exhausted, of executing a recording of a predetermined time or number in continuation.

DETAILED DESCRIPTION OF THE EMBODIMENTS

In the following, embodiments of the present invention will be explained with reference to the accompanying drawings.

Figure 1:
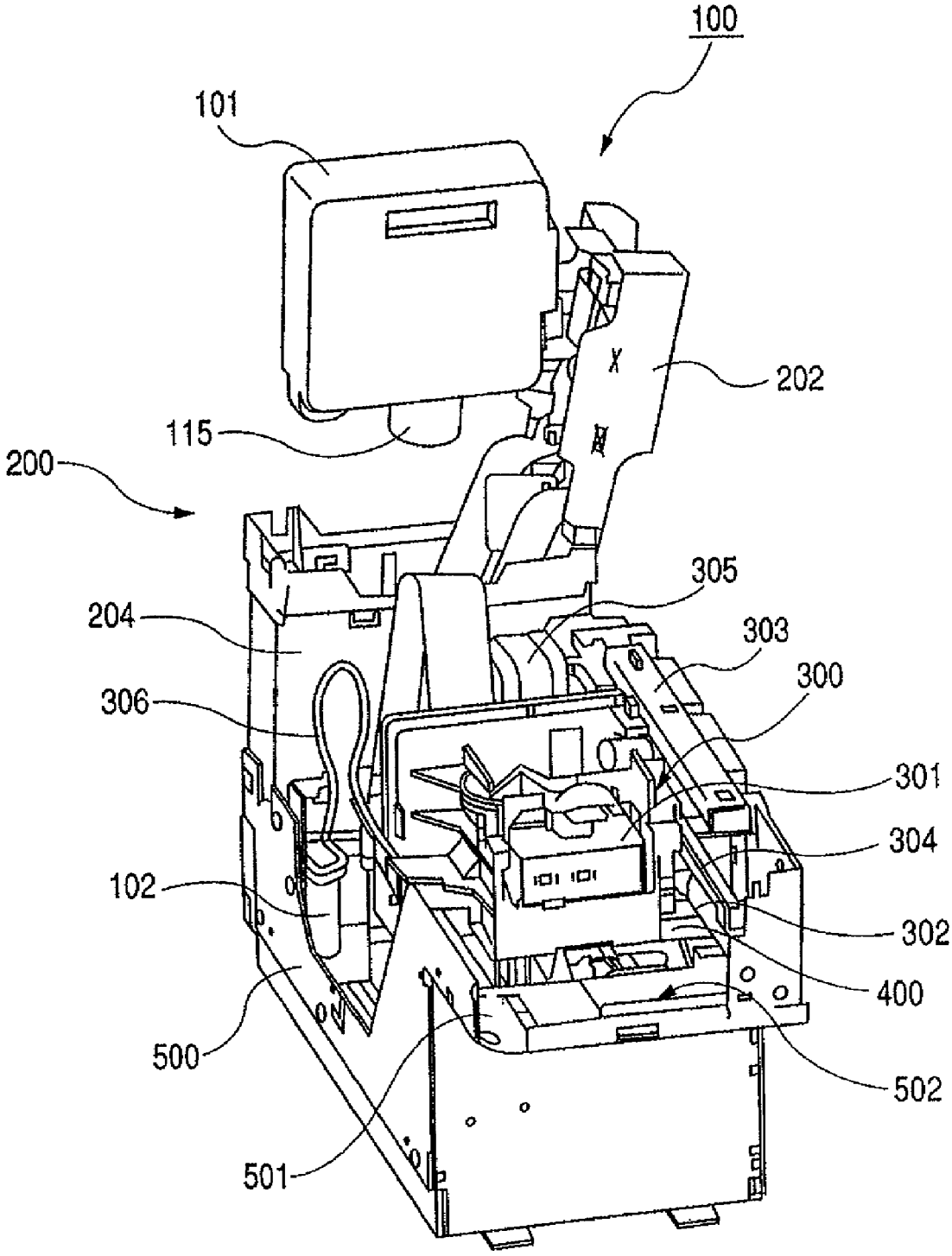
FIG. 1 is a perspective view of an ink jet recording apparatus according to one embodiment of the present invention.

FIG. 1 schematically shows an entire ink jet recording apparatus according to one embodiment of the present invention, in a perspective view in which an external casing is removed. As shown in FIG. 1, an ink jet recording apparatus 10 of the present embodiment is provided with: an ink supply unit 100 which holds a detachable main tank 101, is provided with a sub tank 102 serving as an ink supply part for discharging ink to a discharge head; a carriage unit 300 mounted with a recording head (not shown) for discharging the ink supplied from the ink supply unit 100 and displacing the recording head to a recording position; a recovery system unit 400 for restoring discharge characteristics of the recording head in case of a failure such as an ink discharge failure; and a frame unit 500 for supporting these units.

The ink supply unit 100 is provided with a tank holder 204 having a tank mounting part on which the replaceable main tank 101 is detachably mounted, a tank cover 202 for covering the tank mounting part, and a sub tank 102. The main tank is constructed as an air-tight container.

Figure 2:
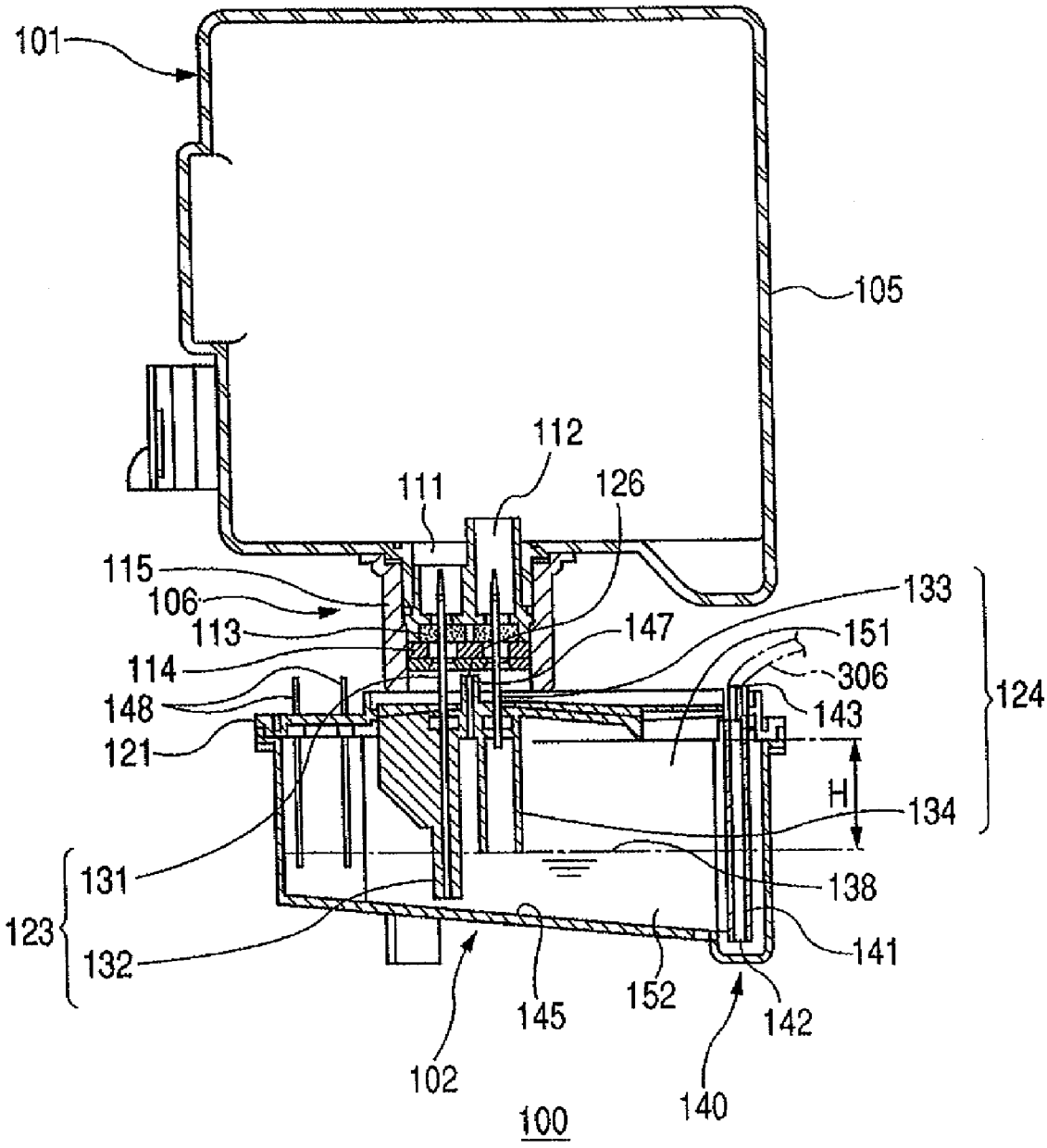
FIG. 2 is a cross-sectional view of an ink supply unit according to one embodiment of the present invention.

The following process takes place when the main tank 101 is mounted on the tank mounting part, as will be explained later in more details. Referring to FIG. 2, a sealing stopper 113 present in a cap member 115, constituting a connecting part 106 of the main tank 101, is connected with an ink supply pin 131 and an air introducing pin 133, which are hollow needles provided at the side of the sub tank 102. Thus, a tank contained in the main tank 101 is supplied to the sub tank 102. The sub tank 102 is connected with a recording head provided on the carriage unit 300 through an ink supply tube 306 constituting an ink supply path.

In the carriage unit 300, a carriage 301 to which the recording head is mounted is supported on a slide shaft 302 and a slide rail 303. Driving power from a carriage motor 305 is transmitted through a driving belt 304 to displace the recording head on the carriage 301 toward a recording position 502.

The recovery system unit 400 is provided, for preventing failure in the recording head mounted on the carriage 300, with a cap member to be contacted with discharge ports of the recording head to cover a discharge port part, a suction pump, and an ink wiping blade.

The frame unit 500 of the ink jet recording apparatus 10 is provided with a protecting plate 501, which is supported by left and right lateral plates and which has an aperture in the recording position 502 by the recording head.

While the carriage 300 is maintained in position by the slide shaft 302 and the slide rail 303, the driving power of the carriage motor 305 is transmitted to the belt 304, thereby displacing the recording head to the recording position 502 provided in a frontal part in FIG. 1 and executing the recording.

Figure 3:
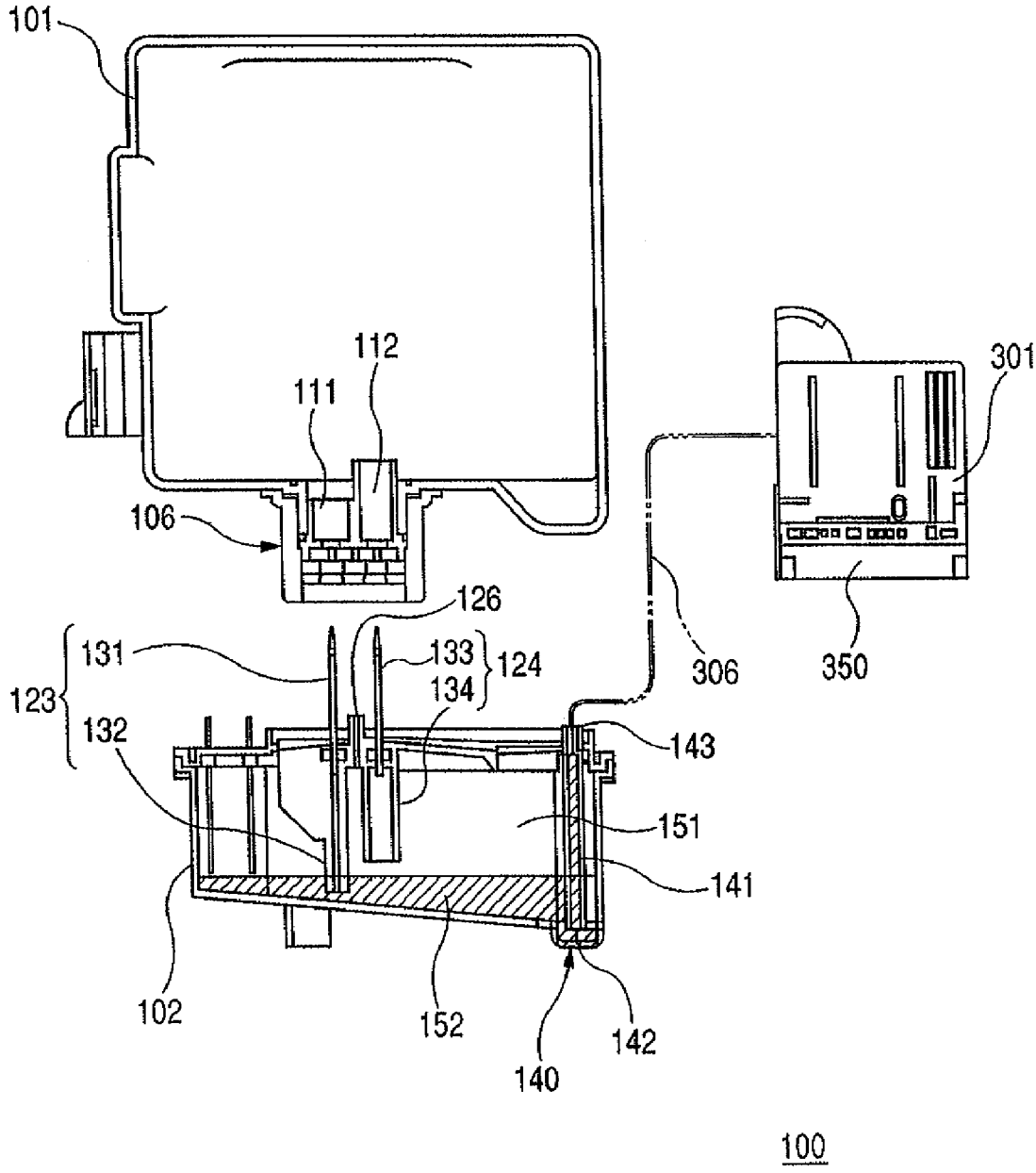
FIG. 3 is a cross-sectional view showing a state where a main tank and a sub tank are separated.

FIG. 2 is a cross-sectional view of the ink supply unit 100 of the ink jet recording apparatus 10, and FIG. 3 is a cross-sectional view showing a state in which the main tank and the sub tank are separated.

As shown in FIGS. 2 and 3, the ink supply unit 100 is constructed so as to facilitate ink supply by a so-called chicken feed system. There are provided the air-tight main tank 101 containing the ink to be supplied to a recording head 350, and the sub tank 102 connected to the main tank and storing the ink supplied therefrom, for supply to the recording head 350.

The main tank 101 is provided detachably on the tank mounting part of the tank holder 204, and is rendered replaceable when the ink is exhausted. The main tank 101 includes a tank main body 105 for containing the ink, a connecting part 106 provided on a bottom face of the tank main body 105 and to be connected to the sub tank 102, and the cap member 115 for covering the connecting part 106.

The connecting part 106 is provided with an ink supply aperture 111 for ink supply to the sub tank 102, and an air introducing aperture 112 for introducing air from the sub tank. It also includes the sealing stopper 113 for respectively closing the ink supply aperture 111 and the air introducing aperture 112 in an air-tight manner, a fixing member 114 for fixing the sealing stopper 113, and the cap member 115 for covering these members. By such constitution, the ink tank assumes an air-tight structure.

The sealing stopper 113 can be formed by an elastic material such as rubber. It is penetrated, by mounting the main tank on the ink jet recording apparatus, across its thickness, by the ink supply pin and the air introducing pin of the sub tank 102 side.

The sub tank 102 is provided on an ink supply path from the main tank 101 to the recording head 350, and is formed by a single ink container having an atmosphere communication port 126. The sub tank 102 is equipped with an ink supply pipe 123 for ink supply from the main tank 101 and an air introducing pipe 124 for introducing air into the main tank 101. The sub tank 102 is further provided with an ink exit part 140 for ink supply to the recording head 350 through the ink supply tube 306, and the atmosphere communication port 126 open to the air.

The ink supply tube 123 includes the ink supply pin 131 for communicating with the ink supply aperture 111 of the main tank 101, and a connecting tube part 132 constituting a flow path connected with the ink supply pin 131. The air introducing tube 124 includes the air introducing pin 133 for communicating with the air introducing aperture 112 of the main tank 101, and a thick tube part 134 connected with the air introducing pin 133. The air introducing tube 124 is extended at a lower end thereof into the sub tank 102, with a length not exceeding that of the ink supply tube 123. The ink supply tube 123 in the present embodiment is constituted of two members, namely the ink supply pin 131 and the connecting tube part 132 connected thereto, but may also be formed by a continuous single member. Similarly, the air introducing tube 124 may also be formed by a continuous single member.

The ink supply pin 131 and the air introducing pin 133 are hollow needles open on both ends, and are provided, at the side of the main tank 101, by an insert molding on an upper part 121 of the sub tank 102 together with a caulking member for clamping. The ink supply pin 131 and the air introducing pin 133 are formed in conical shape at the upper ends thereof, so as to smoothly pierce the sealing stopper 113 of the main tank 101. Also, an aperture for passing ink or air is provided on a peripheral surface close to the upper end. This aperture, when exposed inside the main tank 101, forms a flow path for ink or air. The apertures at the lower ends of the ink supply pin 131 and the air introducing pin 133 are connected to the flow paths constituted, respectively, by the connecting tube part 132 and the thick tube part 134 positioned on the upper part 121 of the sub tank 102. The flow path in the connecting tube part 132 has an internal diameter approximately the same as that of the ink supply pin 131 constituted by a hollow needle. The flow path in the thick tube part 134 has an internal diameter larger than that of the air introducing pin 133 constituted by a hollow pin. The internal diameter of the flow path, namely the cross-sectional area in a direction perpendicular to the air flow direction between the main tank and the sub tank, is made large to an extent that a meniscus cannot be formed by the ink. Because of such structure, the flow path resistance of the air introducing pin 133 and the thick tube part 134 is made smaller than that of the ink supply pin 131 and the connecting tube part 132. The lower end of the thick tube part 134 is extended in a deeper direction in the sub tank 102.

The air introducing tube 124, formed by connecting the air introducing pin 133 and the thick tube part 134, constitutes a flow path for air supply from the sub tank 102 to the main tank 101.

The lower end of the thick tube part 134 defines a liquid level position 138 of the ink stored in the sub tank 102, and maintains the liquid level 138 always at a constant position. Thus, the flow path in the thick tube part 134 facilitates a liquid level maintaining function.

In order to maintain the liquid level in a stable position, the length of the thick tube part 134 in the vertical direction has to be maintained at a water head exceeding the flow path resistance of the air introducing pin 133 and the meniscus force. For this reason, in the air introducing tube 124, as described above, the thick tube part 134 has such a cross-sectional area as not to generate a meniscus in the flow path therein. Thus, a pressure H (mmAq) generated by a water head difference in the vertical direction of the thick tube part 134, a flow path resistance R (mmAq) of the entire air introducing pin 133 and a meniscus force M (mmAq) of the air introducing pin 133 satisfy a relation:

$$H>R+M \quad (1)$$

Thereby, allowing for stably maintaining a constant liquid level in the ink stored in the sub tank 102.

The meniscus force M (mmAq) is represented by a formula representing a surface tension:

$$M=2Y\cdot\cos\theta/r \quad (2)$$

wherein Y: surface tension, θ: contact angle, and r: radius of flow path in the air introducing pin 133.

The flow path resistance R (mmAq) in the entire air introducing pin 133 can be represented by an equation represented as a water head loss:

$$R=32\mu LV/Cd^2 \quad (3)$$

wherein μ: viscosity coefficient, L: length of J-type flow path, V: average flow speed, C: weight of fluid (ink) per unit volume, and d: diameter of flow path.

In the following, there will be explained a gas-liquid exchange operation between the main tank 101 and the sub tank 102, enabled by a water head difference generated in a part of the flow paths constituted of the ink supply tube 123 and the air introducing tube 124.

Figure 4:
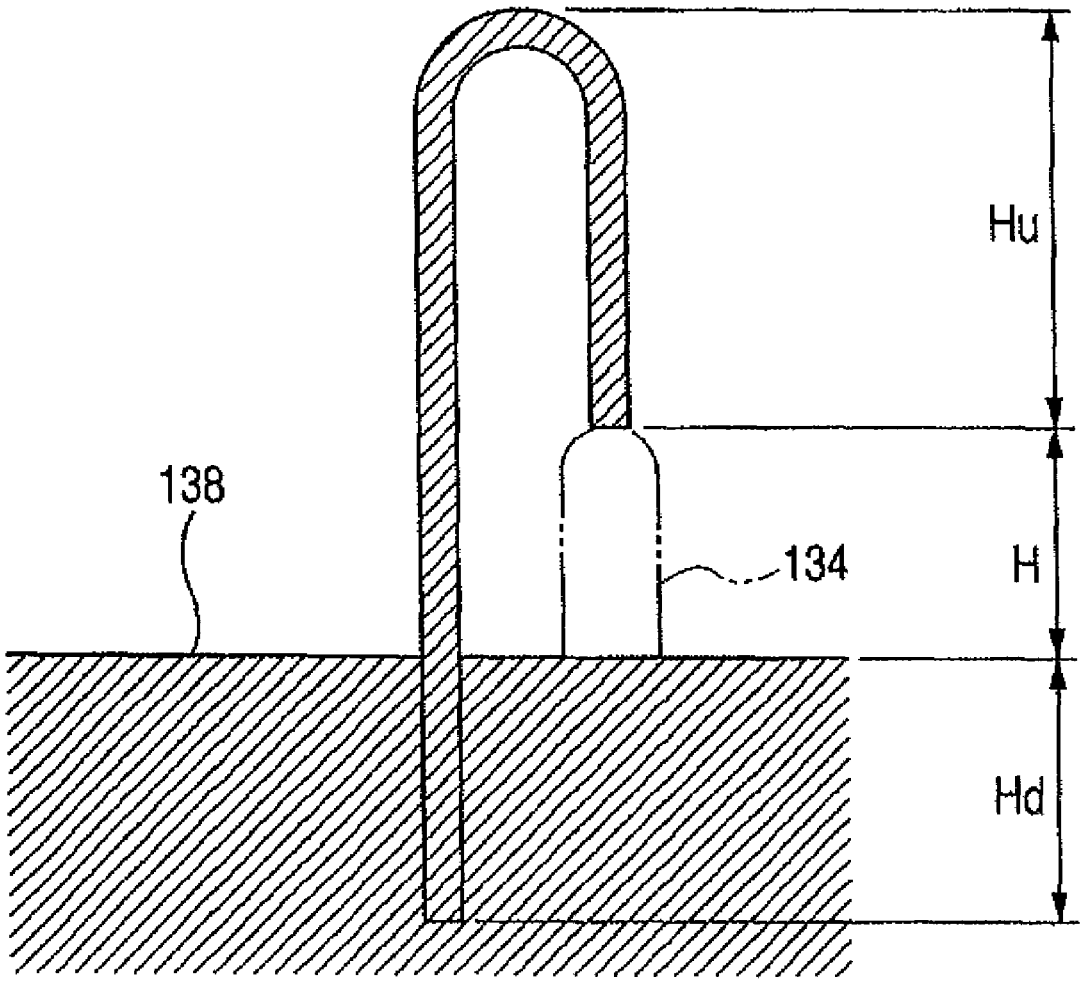
FIG. 4 is a schematic view showing an operation of gas-liquid exchange between the main tank and the sub tank.
Figure 5:
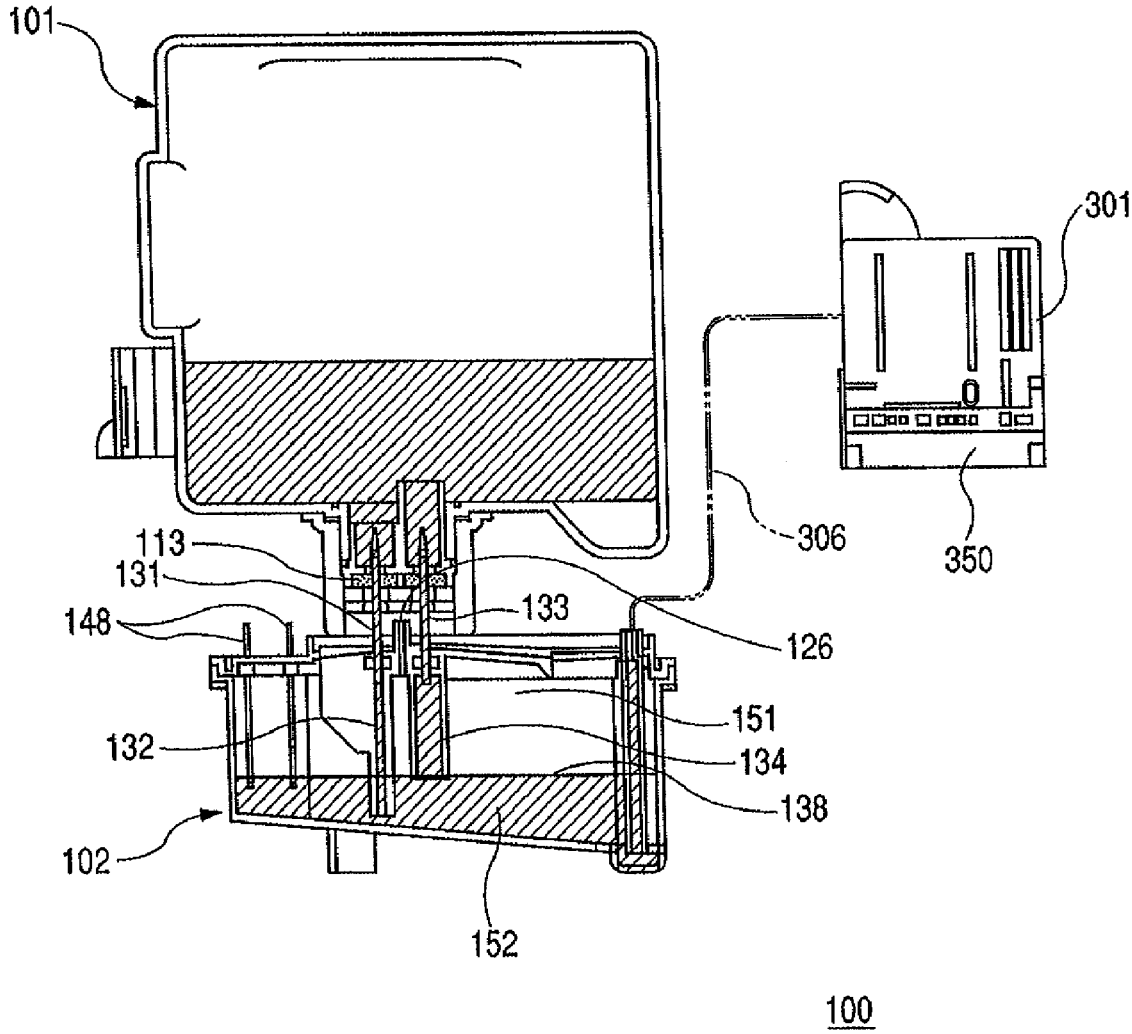
FIG. 5 is a cross-sectional view showing a state where the main tank is connected to the sub tank and the ink in the sub tank is maintained at a constant liquid level.

FIG. 4 schematically shows a flow path constituted by the ink supply tube and the air introducing tube, connecting the main tank and the sub tank. FIG. 5 is a cross-sectional view showing a state where the main tank is connected to the sub tank, and the ink therein is maintained at a constant liquid level.

Referring to FIGS. 4 and 5, as the interior of the main tank 101 is maintained air-tight, a height from the lower end of the air introducing pin 133 to the liquid level position in the main tank 101 corresponds to a partial height Hu of a U-shaped tube. Also, a height of the lower end portion of the connecting tube part 132 immersed in the ink in the sub tank 102, corresponds to a height Hd. A flow path space in the thick tube part 134 corresponds to a height H, and a water head difference of such height H generates a pressure.

At a gas-liquid exchange for ink supply from the main tank 101 to the sub tank 102, a flow path resistance by a height (H+Hu+Hd) in the entire J-shaped flow path shown in FIG. 4 is applied to the ink. At the gas-liquid exchange, the ink in the thick tube part 134 flows toward the air introducing pin 133. At the same time, the ink in the flow path of the air introducing pin 133 is returned to the main tank 101, because of the ink supply from the flow path of the ink supply pin 131 into the sub tank 102.

When a meniscus is formed in an equilibrated state at the upper end aperture of the flow path of the J-shaped tube shown in FIG. 4, namely at the lower end of the air introducing tube 124, the flow path resistance R becomes zero (0) because of absence of flow speed. In such state without the flow speed, the ink does not flow from the main tank 101 to the sub tank 102, thereby realizing a relation H=M.

When a recording operation of the recording head 350 consumes the ink stored in the sub tank 102 and lowers the liquid level position 138, the air enters the flow path in the thick tube part 134 and reaches the lower end of the air introducing pin 133.

The atmospheric pressure at the lower end of the air introducing pin 133 breaks the balanced state H=M to cause the equation (1) to be satisfied, whereby a flow speed is generated to execute a gas-liquid exchange between the main tank 101 and the sub tank 102.

An experimental structure employs ink with a surface tension of about 2 (mN/m) and the air introducing tube 124 constituted of an air introducing pin 133 of an internal diameter of about 1.6 mm connected to a thick tube part 134. In order to realize the aforementioned liquid level maintaining function, the flow path of the thick tube part 134 is required to have an internal diameter of about 8 mm, so as not to form a meniscus.

In the ink stored in the sub tank 102, the liquid level position 138 was maintained in stable manner when the vertical length (water head difference) of the thick tube part 134 was selected as 10 mm or larger. When the thick tube part has the above-mentioned internal diameter but has a vertical length less than 10 mm, a meniscus force on the air introducing pin becomes balanced with the water head difference formed by the thick tube part. In such state, the air introduction into the main tank 101 was interrupted, and the liquid level position did not rise to the lower end of the air introducing pin. The liquid level position 138 maintained constant in the sub tank 102, is positioned lower, in the vertical direction, than the position of a discharge port of the recording head 350. Thus a water head difference between the discharge port and the liquid level position 138 generates a desired meniscus in the discharge port, thereby realizing a satisfactory ink discharging operation.

The sub tank 102 is provided, at a lateral end side thereof, with the ink exit part 140 for supplying the stored ink to the recording head 350. The ink exit part 140 has an ink exit tube 141 having an ink exit aperture 142 at a lower end thereof. The ink exit tube 141 is provided, at an upper end thereof, with a tube connecting aperture 143 to be connected with the ink supply tube 306 for ink supply to the recording head 350, and is supported, in an upper end portion thereof, by the upper part 121 of the sub tank 102. Therefore, the ink, supplied from the main tank 101 and temporarily stored in the sub tank 102, is discharged from the ink exit aperture 142.

The ink is supplied, through the ink supply tube 306, to the recording head 350 on the carriage 301. Also, the sub tank 102 is provided, on a bottom thereof, with an inclined face becoming progressively deeper in the vertical direction from the side of the ink supply tube 123 to the side of the ink exit part 140. The ink exit aperture 142 is provided in a lowermost deepest position, whereby the ink stored in the sub tank 102 can be smoothly discharged from the ink exit aperture 142 and can be satisfactorily used up. The air introducing tube 124 is provided in a position closer, than the ink supply tube 123, to the ink exit aperture 142.

A pigment colorant has been recently employed in the ink, but a recording in an ink state where the pigment component is precipitated and separated may generate a density unevenness in the recorded image. Therefore, for the purpose of agitating the entire ink stored in the sub tank, the ink supply unit of the present invention adopts the following constitution.

The flow path of the connecting tube part 132 constituting the ink supply tube 123 form the main tank 101 and the ink exit aperture 142 of the ink exit part 140 for ink supply to the recording head 350 are provided in mutually separated positions. Also, the inclined face 145 is provided on the bottom of the sub tank 102, and the flow path of the connecting tube part 132 is provided at an upstream side of such inclined face 145. It is thus rendered possible to sufficiently agitate the precipitated pigment component in the entire volume, thereby realizing satisfactory recording without causing a density unevenness.

The upper part 121 of the sub tank 102 is provided, on a top surface thereof, with an integrally formed protruding part 147, positioned between the ink supply pin 131 and the air introducing pin 133. The protruding part 147 has an air path, formed in the vertical direction, of which an upper end constitutes the atmosphere communication port 126. As the atmosphere communication port of the sub tank is positioned at the upper end of the protruding part 147, the protruding part serves as a partition wall between the ink supply pin and the air introducing pin, thereby limiting a spreading area for the eventually leaking ink. Also, the thick tube part 134 of the air introducing tube 124 is provided in a position adjacent to the atmosphere communication port 126.

In the upper part 121 of the sub tank 102, two ink detecting plates 148, that can be rendered electrically conductive, are provided with a space therebetween. These ink detecting plates 148 are extended, in lower end portions thereof, to a position somewhat lower than the liquid level position 138 maintained constantly in the sub tank 102, and are immersed in the ink. Also, the ink detecting plates 148 are electrically connected, at upper end portions exposed outside the sub tank 102, to a control circuit (not shown) provided in the ink jet recording apparatus.

In the ink supply unit, when the ink in the main tank 101 is exhausted, the ink amount in the sub tank 102 decreases because of the interruption of ink supply from the main tank 101, whereby the liquid level position 138 of the ink is lowered in the sub tank 102. Because of the lowered liquid level position 138 of the ink in the sub tank 102, the lower end portions of the two ink detecting plates 148, that have been immersed in the ink, come out of the ink and exposed in the air, thereby terminating the electrical conductive state. The control circuit detects such state, thereby identifying a descent of the liquid level position 138.

In the ink containing part of the sub tank 102, an upper space 151 and a lower space 152, with respect to the lower end of the flow path of the thick tube part 134 of the air introducing tube 124 (namely the liquid level position 138), have different functions for containing the ink. Now, consider a situation where the gas in the closed main tank 101 causes a volume change by a temperature change in the environment. The upper space 151 serves as an ink container for temporarily storing the excessively supplied ink, when the ink in the main tank 101 is pressed out to the sub tank 102 in excess of the ink consumption by the recording head 350. Within the extent of a temperature change encountered in an ordinary use, the ink excessively pressed out from the main tank 101 is contained in the upper space 151 of the sub tank 102 as a container. When the temperature returns to the original state, the internal pressure of the main tank 101 is lowered whereby the ink that has flown to the sub tank 102 is returned again to the main tank 101. In case of a temperature change exceeding the extent of ordinary use, the ink flowing out from the main tank 101 to the sub tank 102, after filling the upper space 151, is discharged from the atmosphere communication port 126.

The lower space 152 of the sub tank 102 serves as an ink container for containing the ink of a predetermined amount in the sub tank 102. When the ink in the main tank 101 is exhausted, the ink supply therefrom to the sub tank is terminated. Therefore, even in a state where the main tank 101 is detached from the tank mounting part, it functions as an ink container for enabling continued recording.

When the ink in the main tank 101 is exhausted, the ink supply unit no longer receives ink supply from the main tank 101. As a result of ink discharging operation by the recording head 350, the liquid level position in the sub tank 102 is gradually lowered, whereby the lower end portions of the ink detecting plates 148 emerge from the ink and are exposed in the air. Based on such state of the ink detecting plates 148, the control circuit detects a descent of the liquid level position 138, and generates an alarm such as a display indicating the absence of ink in the main tank 101, thereby requesting the user to replace the main tank 101. The ink jet recording apparatus is constructed such that the control circuit electrically detects the liquid level position 138 in the sub tank 102. Since no electrical signal is exchanged with the main tank 101, the control system of the ink jet recording apparatus is not at all affected even when the main tank 101 is detached from the apparatus. Therefore, even in a state where the main tank 101 is detached from the tank mounting part, the ink jet recording apparatus continues the recording operation utilizing the ink of a predetermined amount stored in the space below the liquid level position 138.

As the recording operation can be continued until the liquid level position reaches the ink exit aperture 142 in the lowest position of the sub tank 102, there can be prevented, in the course of the recording operation, a recording failure by an interruption in the ink discharge from the recording head 350. In an ink jet recording apparatus, the recording operation may be abruptly interrupted by a lack of ink, when the main tank is detached.

In case of a continuous printing operation or a large-sized printing, the printing operation may be interrupted in the course of printing a sheet. With respect to these cases, the liquid level position may be determined by selecting the flow path resistance and the length of the ink supply tube or the air introducing tube of the sub tank so as to secure an ink amount enabling continuation of the recording operation of a predetermined amount. For example, it is possible to estimate a time required for replacing the main tank after it is detached, and to enable continuation of the recording operation during such time.

The ink can be contained in the lower space of the sub tank, under thus determined liquid level position.

It is also possible to determine the liquid level position in the sub tank by estimating the ink amount enabling continuation of the recording of a predetermined number of sheets after the main tank is detached.

In the ink supply unit of the present embodiment, the thick tube part 134 of the air introducing tube 124 is sized so that a meniscus is not formed in the flow path of the thick tube part 134. It is thus possible, by always generating a difference in the flow path resistance in the air introducing pin 133 and the thick tube part 134, to maintain a constant liquid level position 138 in the ink stored in the sub tank 102. Also, a desired meniscus can be generated in the recording head 350 by a water head difference between the liquid level position 138 maintained constantly in the sub tank 102 and the discharge port of the recording head 350.

The ink supply unit of the ink jet recording apparatus of the present embodiment employs a chicken feed type for ink supply from the main tank 101 to the sub tank 102. Even in the case of utilizing a hollow needle having a relatively small diameter such as the air introducing pin 133, the present embodiment can maintain a constant liquid level position 138 without being influenced by a meniscus that appears more easily in a finer hollow needle. It is thus possible to prevent a stagnation in the ink supply from the main tank 101 to the sub tank 102, thereby achieving a smooth ink supply to the recording head 350. Thus, this ink supply unit can stabilize the water head difference for maintaining the meniscus in the nozzles of the recording head 350, thereby improving the reliability of ink supply operation thereto.

Also, the liquid level position 138 in the sub tank 102 can be determined so as to secure the ink amount to enable continued recording of a predetermined amount. Therefore, the sub tank 102 stores a predetermined amount of ink, even after the ink in the main tank 101 is exhausted or even in a state where the main tank 101 is detached from the sub tank 102.

The recording can be continued for a predetermined constant time or on a predetermined number of recording sheets, until the ink stored in the sub tank is consumed.

In this ink supply unit, the single sub tank 102 includes the upper space 151 for accommodating the ink flowing out from the main tank 101 by a temperature change. The ink supply unit also includes the lower space 152 for storing a predetermined amount of ink for continuing the recording operation even after the ink in the main tank 101 is exhausted. Such constitution achieves, by a single ink container, improvement in plural functions of the ink jet recording apparatus, thereby realizing a more compact apparatus.

Other Embodiments

In the following, an ink supply unit of another embodiment of the present invention will be explained with reference to the accompanying drawings. The ink supply unit of another embodiment is different in that the main tank 101 and the sub tank 102 are positioned in a separate manner. As its basic structure is approximately the same as that of the foregoing embodiment, like components will be represented by like numbers and further explanation is omitted.

Figure 6:
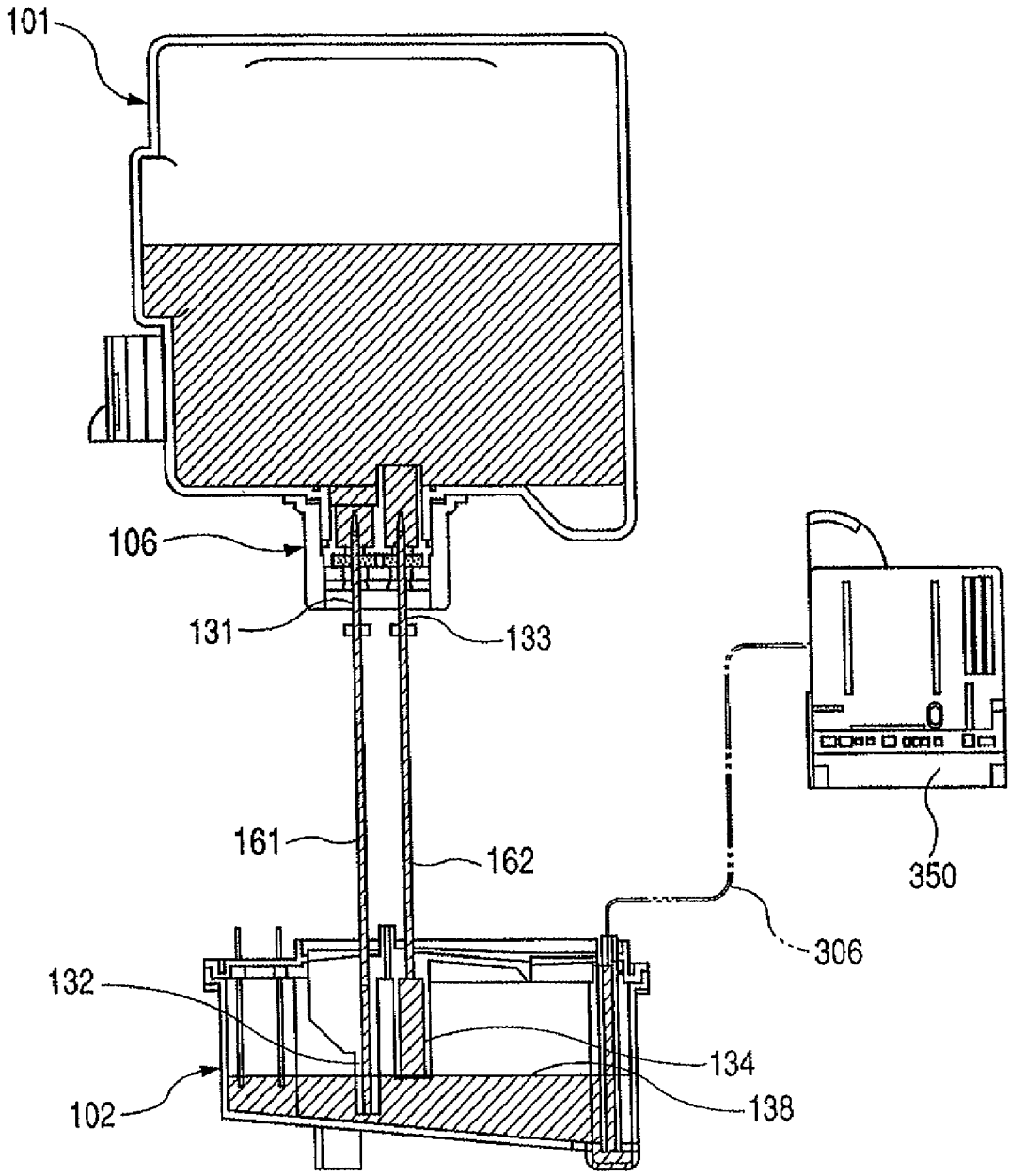
FIG. 6 is a cross-sectional view showing an ink supply unit in accordance with another embodiment of the present invention.
Figure 7:
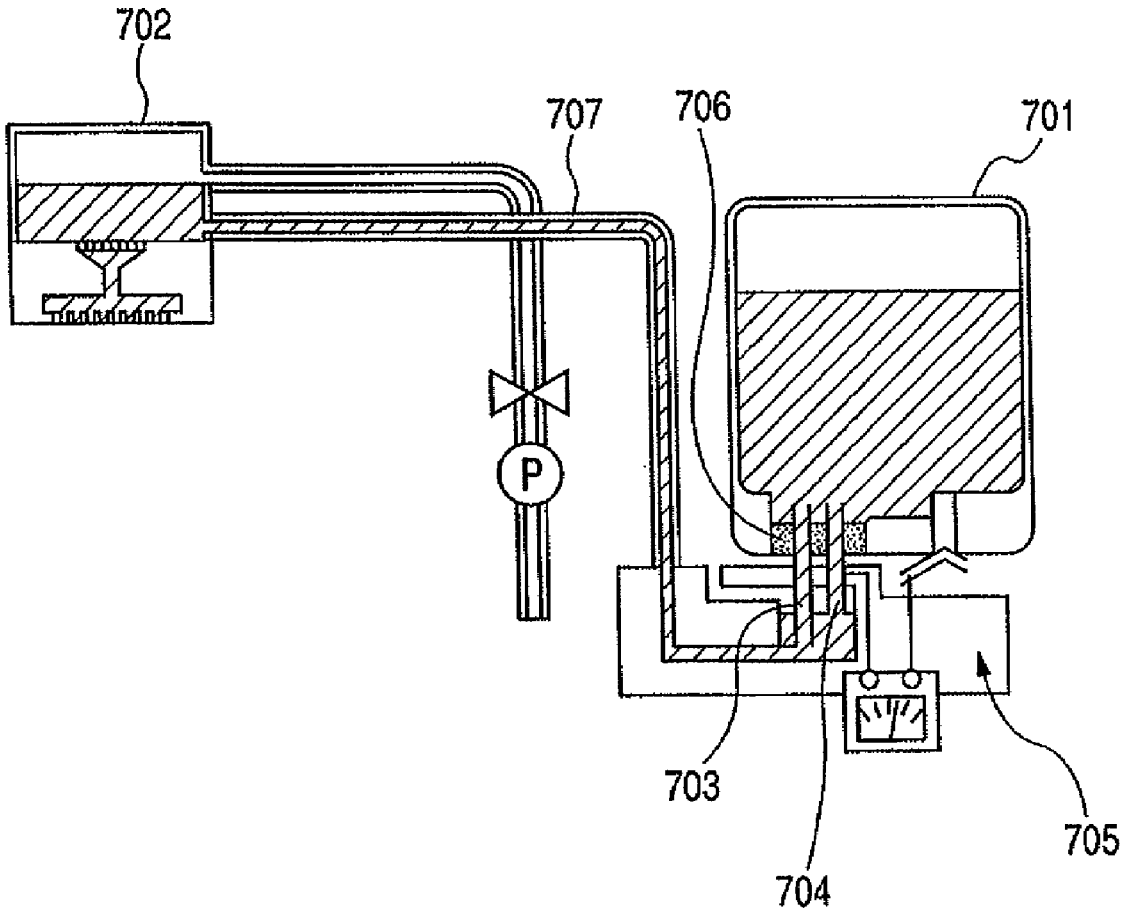
FIG. 7 PRIOR ART
FIG. 7 is a schematic cross-sectional view showing a known ink supply apparatus.

As shown in FIG. 6, in the sub tank provided in the ink supply unit, the lower end of the ink supply pin 131 and the upper end of the connecting tube part 132 are connected by an ink supply tube 161. Also, in the sub tank 102, the lower end of the air introducing pin 133 and the upper end of the thick tube part 134 are connected by an air introducing tube 162. Such ink supply tube 161 and air introducing tube 162 have internal diameters respectively substantially equal to those of the ink supply pin 131 and the air introducing pin 133.

The ink supply unit supplies ink from the main tank 101 to the sub tank 102 through the ink supply tube 161 and the air introducing tube 162. A gas-liquid exchange is executed in the same manner as in the above-described embodiment, whereby the liquid level position of the ink stored in the sub tank 102 is maintained constantly.

In the ink supply unit of the present embodiment, the main tank 101 and the sub tank 102 are connected via the ink supply tube 161 and the ink introducing tube 162. This allows for greater freedom in positioning the main tank 101 and the sub tank 102 within the ink jet recording apparatus.

In the above-described embodiments, the thick tube part 134 of the air introducing tube 124 performing the liquid level maintaining function is formed cylindrically, but it is not limited to a cylindrical shape. The tube part can have any other shape not generating a meniscus of the ink, for example, a conical shape in which the internal diameter gradually changes along the direction of length, or a shape in which an internal wall of the flow path is inclined to the vertical direction. The effect of stably maintaining a constant liquid level position 138 can be obtained in a similar manner.

In the ink supply unit of the foregoing embodiments, the air introducing tube 124 is formed by connecting the air introducing pin 133 and the thick tube part 134 of different internal diameters. However, the aforementioned effects can also be obtained by utilizing an air introducing tube having a straight tube shape in which the internal diameter does not change along its length. In such structure, the air introducing tube is formed, over the entire length thereof, with such a cross-sectional area as not to generate a meniscus. More specifically, it is structured so that a water head difference H in the vertical direction of the entire air introducing tube, a meniscus force M by the meniscus in the ink supply tube and a flow path resistance R of the ink supply pipe satisfy the aforementioned relation: H>R+M.

Also, among the two flow paths provided in the sub tank and capable of communicating with the main tank, the air introducing path may have an inclined face, at the lower end aperture in the sub tank, so as to realize an end face of a size sufficiently large for not forming a meniscus.

What is claimed is:

1. An ink jet recording apparatus comprising:

a recording head for recording by discharging ink;

a main tank configured to contain ink to be supplied to the recording head; and a sub tank configured to store the ink supplied from the main tank and capable of supplying the ink to the recording head, wherein the sub tank has an ink supply path for supplying ink from the main tank and an air introducing path for introducing air into the main tank, wherein a length of the air introducing path is shorter than that of the ink supply path and a flow path resistance of the air introducing path is smaller than that of the ink supply path, wherein the air introducing path has:

an air introducing pin provided at a side of the main tank and a first cross-sectional area; and a thick tube part provided at a side of the sub tank and a second cross-sectional area greater than the first cross-section area, and wherein the following formula is satisfied, $$H>M+R$$

where pressure by a vertical water head difference of the thick tube part is (H), the flow path resistance of the air introducing pin is (R) and a meniscus of the air introducing pin is (M).

2. An ink jet recording apparatus according to claim 1, wherein each of the ink supply path and the air introducing path provided in the sub tank is formed by connecting two flow path members.

3. An ink jet recording apparatus according to claim 1, wherein the air introducing path provided in the sub tank is positioned closer, than the liquid supply path, to a liquid exit part to the discharge head.

4. An ink jet recording apparatus according to claim 1, wherein a bottom face of the sub tank has an inclined face becoming deeper toward a liquid exit part to the discharge head, and wherein the liquid exit part is formed in a proximity of a deepest part within the sub tank.

5. An ink jet recording apparatus according to claim 1, wherein a lower end position of the air introducing path provided in the sub tank defines a predetermined liquid level position, and wherein a liquid amount secured in the sub tank by the liquid level position is a predetermined amount of the liquid capable of continuing a predetermined amount of recording.

* * * * *